United States Patent [19]

Yost et al.

[11] 4,064,501

[45] Dec. 20, 1977

[54] CONTROL SYSTEM

[75] Inventors: Charles N. Yost; Millard R. Bolyard; Leon M. Whitmer, all of Frederick, Md.

[73] Assignee: Unitrol, Inc., Frederick, Md.

[21] Appl. No.: 608,635

[22] Filed: Aug. 28, 1975

[51] Int. Cl.[2] ..... G08B 21/00; G07B 15/00; G07C 11/00

[52] U.S. Cl. ..... 340/286 R; 235/92 FP; 235/92 TC; 340/23; 340/51

[58] Field of Search ..... 340/286, 51, 23; 317/137; 235/92 TC, 92 FP, 92 MS, 92 PD

[56] References Cited

U.S. PATENT DOCUMENTS

| | | | |
|---|---|---|---|
| 3,705,976 | 12/1972 | Platzman | 340/51 X |
| 3,766,363 | 10/1973 | Dhooge | 340/51 X |
| 3,803,578 | 4/1974 | LaVanway | 340/286 |
| 3,886,414 | 5/1975 | Lach et al. | 340/51 X |
| 3,950,725 | 4/1976 | Kitajima | 340/51 X |

*Primary Examiner*—Glen R. Swann, III
*Attorney, Agent, or Firm*—C. W. Mortenson

[57] ABSTRACT

By this invention a system for controlling the servicing of customers arriving in a vehicle at a service area is provided, in which system the arrival of the vehicle, the supplying of the services and the departure of the vehicle is monitored. The system includes a number of signals which keep the attendants in or near the service area fully informed as to the status of the operations that are going on relative to a given vehicle. Thus, the arrival of the vehicle is announced and that arrival sets into operation a control means which is responsive to an unauthorized departure of the vehicle. In other words, if a vehicle attempts to leave the service area before the service is completed or before the services have been paid for, an alarm is activated by the control means announcing the impending unauthorized departure. Present also in the system is a means for preventing any of the signals from functioning in the absence of a vehicle that has come into the service area for service. Also present is a means for announcing the proper completion and authorized departure of a given vehicle from a given service area. The various steps involved in a given service that is being offered are programmed and the system includes a means for preventing the actuating of any given alarm other than in its programmed sequence.

The system provided by this invention includes the monitoring of several different service areas. Electrical circuitry is involved with respect to each of the given service areas so that the control information is fed from the given service area independently of events that are happening in any other service area, but all of the electrical circuitry relative to the various service areas are powered from the same power source. Thus, this invention comprises the processes involved for effecting the monitoring, the overall system, and the electrical circuitry involved, all of which appear hereinafter.

21 Claims, 1 Drawing Figure

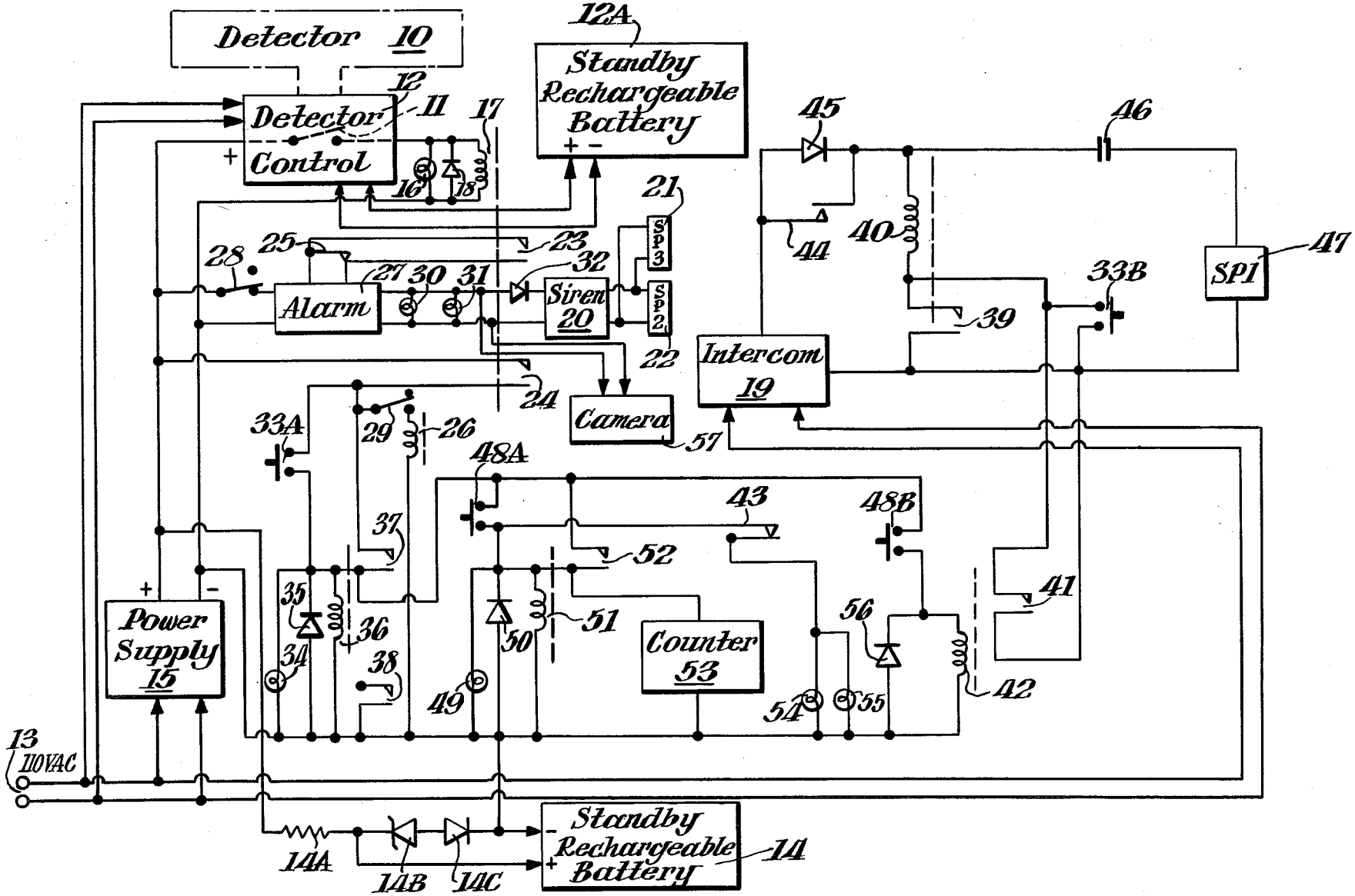
Detector 10
Detector
Control
Standby Rechargeable Battery
Standby Rechargeable Battery
Intercom 19
Siren 20
Alarm
Camera
Counter 53
Power Supply 15
110VAC
SP1
SP2
SP3

CONTROL SYSTEM

BRIEF SUMMARY OF THE INVENTION

This invention relates to a control system which comprises a service area into which a vehicle is driven by a customer seeking the services offered in said area and is brought to a stop in said area; relative to the presence of said vehicle, there is a means responsive to its arrival which energizes an alarm announcing the arrival and also energizes a control means which is responsive to any unauthorized departure of the vehicle; the said control means activates an alarm informing attendants present that the vehicle is leaving or has left in an unauthorized manner, it being impossible, because of the electrical circuitry that is involved, for the control means to be energized in the absence of a stopped vehicle. Present also is a means for announcing the unauthorized departure of the vehicle which means is activated by an attendant at the proper time and the system includes means that prevent a given alarm from becoming activated at any time other than at its proper time in the programmed sequence. Thus, even though there are a plurality of steps involved in the supplying of the services sought by the customer arriving in the vehicle, no alarm other than a clear signal that all is well will appear unless the vehicle attempts to leave in an unauthorized fashion, there being a plurality of alarms or signals informing the attendants as to the completion of each step of servicing as they progress.

BRIEF DESCRIPTION OF THE DRAWING

The accompanying FIGURE is an electrical circuitry in line diagram showing the electrical and/or electronic elements involved in the control system of this invention.

DETAILED DESCRIPTION

With the increasing number of vehicles such as trucks, buses, automobiles, and other motor vehicles on the highways, there is an ever increasing demand for services at a variety of service areas including gasoline stations, truck stops, garages, self-service fuel islands, drive-up bank facilities, drive-in restaurants, or any such establishment that offers the fueling of or any service function relative to a motor vehicle and/or its occupant(s). With this said increase there is also a substantial increase in the number of motor vehicles which drive off without paying for the products or the services received. The losses involved are very substantial, and there has been an increasing need for controlling the servicing of vehicles to reduce and minimize such improper departures. Thus, an object of this invention is to provide a system for controlling the servicing of vehicles whereby the attendant or attendants present are kept fully informed as to the progrss of the servicing and are immediately informed if a vehicle attempts to leave or has left without paying. A further objective is to provide in such a system means for controlling the plurality of service areas. A still further aim is to provide electrical circuitry which is tied into the movement or non-movement of the vehicle so that proper alarms can be activated relative to the movement or non-movement of the vehicle. A still further purpose of this invention is the provision of a means for allowing an attendant present in the service area to be as fully informed as and to be able to communicate quickly with an attendant who is at some point remote from the service area such as a cashier's office within a building opposed to the service area outside the building.

The objectives of this invention are accomplished by providing a module unit for each service area outside a given building and there may be any number of such as desired, and a console unit inside a building contiguous with the service areas. The said module unit feeds information to the cashier or other attendant in the control room. The module unit, which can be contained on or in a console, has an alarm switch for on and off positions and which allows the inside attendant to communicate via an intercommunication device with the attendant outside. It also contains a plurality of lights of different colors each of which indicates the status of the servicing operation that is going on outside for each service area. Each of these lights goes on in a programmed sequence and not one of them can go on in other than its proper sequence. The console also contains a keyed reset and a slot to hold an invoice or any indicia of products purchased, services to be performed, or money to be paid, and the like by the subject customer. There is present also a counter with a reset and for each service area or lane of travel for a vehicle there is a means for informing the inside attendant which service area or lane of traffic is being monitored at a given time.

Before describing the electrical circuitry involved, it may be beneficial to describe the events that occur in a step-wise fashion. The first thing that happens when a vehicle pulls into a service area is the sensing of its presence which sensing leads to the illumination of a white light on the module for that particular area of service or some other such signal which tells the attendant that a vehicle has arrived and has stopped. With reference to a gasoline truck stop service station, the attendant on the particular island then obtains from the driver of the vehicle the instructions for fueling or whatever other services are requested by the driver and how the driver intends to pay for the product requested or services given. The attendant informs the driver of the lane number that his vehicle is in, which information the driver presents to the cashier when he goes to pay his bill, leaving the truck in its stopped position at the service area. This having been done, the island attendant then turns on the switch which announces that the service requested has been started. The white light remains on but an amber light then goes on also and an audible signal and indicator light are also activated whereupon the inside attendant turns the alarm switch that is on the console to its ON position. This enables the inside and the outside attendants to communicate via the intercom in which communication the island attendant tells the inside cashier how the customer is going to pay - that is, by check, cash or credit card, enabling the cashier to obtain and begin processing the proper invoices. With the invoice filled out with everything upon it except the amount of money due and the amount and kind or product supplied, the cashier puts the invoice at a location corresponding to the number of the station which is involved in the servicing. While this is being done the island attendant usually completes the servicing and actuates the "service finished" switch located at the fuel island thus turning on the blue light with all the other lamps remaining on. Again, the audible signal and the light tell the cashier that he can now determine the amount and kind of products and the costs thereof involved from the island attendant and he then completes the invoice, replacing it in its proper location. The driver of the vehicle then comes to the fuel desk inside the building or near the building and informs the cashier of his lane number whereupon the cashier obtains the proper invoice from the proper location and receives payment. Upon receipt of payment, the cashier then turns the alarm switch into the OFF position and that causes a green light to go on which is located both at the consolee inside and at the control module outside. This indicates that the invoice has been paid and the truck may be moved. In the event that the driver fails to bill his bill and attempts to move the vehicle from the service area the circuitry involved with the alarm switch still in the ON position, causes an audible alarm to be sounded, both at the console inside and at the outside service area and at the console and control module a red light comes on and the alarm is sounded so that the driver can be apprehended, or the attendant can immediately call the police. The attendant having already noted the make of the vehicle, the license number and the like, can immediately give the enforcement officer all the necessary information that he needs to apprehend the driver of the vehicle.

The electrical circuitry that is involved would announce the passage of other vehicles such as yard sweepers, automobiles, trucks, over the detecting device, but they can move freely around all other service areas without interfering with or without inadvertently activating or deactivating the operation of the system. Also, a vehicle that drives through a given fuel or service station without stopping does not interfere with the system since the alarm control circuit does not become active until the cashier turns same on. While the above running description in the step-wise fashion has been directed to a truck stop, it is to be appreciated that the control system of this invention may be used relative to warehouses, self-service fuel islands, restaurants, drive-up bank operations, and the like.

As shown in the accompanying figure which comprises a circuitry effecting the objectives of this invention, 10 indicates an underground loop circuit positioned at a spot where a car, truck or other vehicle will come to a stop to purchase gasoline, diesel fuel, or receive other service at a typically manned fuel island, self-service station, garage or service area including drive-up order or bank service facilities. It is normally ohmically connected to an inductive switch, although other detectors such as a photo-beam device, vehicle weight plate, or air-hose type of detecting switch may be used. Whatever the detection device, be it inductive, photo-electric, vehicle weight plate, air-hose, etc. it activates a switch 11 in the detector control 12. Said detector control 12 receives its power, as do all elements in the system, from power source 13, a typical 110 volt, alternating current outlet. Said detector control 12 has associated with it a standby rechargeable battery 12A to provide for back up emergency power during an instantaneous power outage such as during a thunderstorm to prevent a false detection of a drive-off due to the loss of power. Also provided is standby rechargeable battery 14 and its associated trickle charging circuitry comprising resistor 14A, zener diode 14B, and silicon diode 14C, all of which are typical trickle charging components to limit the charging voltage and rate, and to prevent discharge while the circuit is operating. Standby power unit 14 is provided such that a power failure would not disable or activate or adversely affect any alarm in the system or the control system status. Connected to said AC power supply is low voltage power supply 15 the DC output of which is connected to standby power unit 14 and to switch 11 so that closure of which by vehicle detection activates lamp 16, usually a white, incandescent bulb of substantial intensity, which is in parallel with the coil winding of relay 17 and diode 18, the latter being present to suppress any electrical interference that may or may not interfere with the voice communication of other lanes of operation using intercom 19. Instead of or along with lamp 16, an audible element, such as a bell or chime, may be used though generally and preferably only the lamp is present. Said lamp is permanently attached to a visual display panel of the alarm console and when lit designates that a vehicle is stopped on the detector 10.

It will be appreciated that for each lane of traffic leading to a given fuel island or service area there will be a separate unit comprising all the elements being described, with the following exceptions: 110 volt AC power unit 13, standby power unit 14, low voltage power supply 15, intercom 19, electronic siren module 20, console speaker 21, and outdoor speaker 22, as these units are jointly used by all lanes for complete operation of the system. Also, it is to be understood that the detector unit 10 will, though located at the fuel island or service area, be electrically connected to a control unit or units located in a control room or fuel desk, or any other location used for cashiering, recording, or invoicing of the fuel or other services rendered, such control unit being some distance away from the service area, for example, in a building where the cashier and overseer of the entire outside operations will be active in monitoring the operations. It will also be appreciated that each detector and its corresponding electronic or mechanical control circuitry will be interconnected to a display console housing and to the mutually used items of the system, in particular, standby power unit 14, low voltage power supply 15, intercom 19, electronic siren module 20 and console speaker 21. Said console normally and preferably has a visual display for monitoring status of each service lane as will be described hereinafter.

As previously described, a vehicle stopping on detector 10, would activate detector switch 11 and the closure of this illumnates lamp 16 and induces a voltage across the coil of relay 17. Said relay coil having the typical characteristics of an electromagnet attracts and closely relay contacts 23 and 24, contact 23 being designed such that it is in parallel with contact 25 of relay 26 and also in a parallel shunt of the contacts of alarm control 27. Said alarm control 27 receives its power through a keyed reset switch 28 from power supply 15. Operation of the alarm control 27 is allowed to be disabled by means of reset switch 28 in order to allow for equipment repair, system disablement or to reset the alarm control 27 if a vehicle does indeed drive of as will later be described. Reset switch 28 is keyed in order to maintain the security of its use for alarm detection. Contact 24 of relay 17 has been closed with the stopping of a vehicle on detector 10, and said contact supplies low voltage DC from power supply 15 to other portions of circuitry for visual and communication purposes and provides power to the alarm activation switch 29, said switch being connected to the coil of relay 26. Upon the energizing of coil 26 its associated relay contact 25 will open, which is in parallel with contact 23 of the vehicle detection circuit leaving contact 23 the only means of maintaining alarm circuit 27 from tripping provided that the reset switch 28 is in the ON position to provide DC power to said alarm circuit. If at this point in time, a vehicle leaves its previously stopped position and consequently opens switch 11 through detector 12, the loss of DC voltage through switch 11 causes relay coil 17 to de-energize and therefor open the contacts of the alarm control 27 causing said alarm control 27 to activate and supply DC voltage to console alarm lamp 30, service area alarm lamp 31, diode 32 photographic camera 57, and the following mutually used components, siren 20 sounding an audible alarm through console speaker 21 and outdoor speaker 22. Lamps 30 and 31 are similar in style and design to lamp 16, typically red in color with lamp 31 being weatherproofed for its outdoor use. The purpose of lamp 30 is to indicate on the console which lane of service had a drive-off so that the cashier or attendant could take the necessary actions to deter the vehicle from leaving and to notify the authorities of said violation, if so desired, or if such is the usual and customary practice. Fuel island alarm lamp 31 would identify to the attendant or customer which lane has had a drive-off, in case more than one vehicle was in motion at the same time. Camera 57, a typical film or video camera, would be so mounted in order to provide physical evidence of the violation, in particular, the license plate at a self-service station.

Diode 32 is provided in a reversed electrical state so that it is used as a DC blocking diode in order that all alarm circuits from the other lanes are able to use mutually the single electronic siren module 20 and its associated speakers 21 and 22. Once the drive-off lane is identified, the cashier or operator can reset the alarm control 27 by turning the alarm switch 29 to the OFF position which shunts out the alarm control 27 and then turning reset switch 28 to the OFF position and then back to the ON position. Said procedure turns off the voltage that was supplied to lamps 30 and 31 and electronic siren module 20 during the alarm condition, and resets the alarm control 27.

As part of the control system the console and visual display are preferably designed and operated so that the vehicle identification and description is marked on a travel ticket or invoice stored in the same line or close to the visual display of lamps for the particular lane of service. This would make identification of the vehicle readily available as well as pertinent information concerning billing: type of fuel, service rendered, gallons used, dollar value of same, etc.

The circuit operation is so designed that the alarm switch 29 will not electrically function to energize relay coil 26 unless there is a vehicle stopped, as there would be no voltage through contact 24. This disabling feature would prevent the cashier or operator from accidently setting off the alarm by turning the alarm switch ON if there was no vehicle present. The remainder of the circuit is also so designed that all functions, as will later be described, have to occur in the proper sequence.

Assuming that a vehicle stops on detector 10 and lamp 16 illuminates to identify the lane and relay contacts 23 and 24 close, the vehicle operator, may, if he so decided, for any reason such as a high fuel rate charge, or simply ask directions, or obtain some service such as air pressure, for which there is no charge, continue on his way and drive off without sounding an alarm, as the cashier did not activate alarm switch 29. Assuming that a vehicle stops on detector 10 and does want service for which a fee will be paid, the following sequence will occur in addition to the lighting of vehicle stopped lamp 16. After having determined from the driver the method of payment and type of service required, the attendant or customer activates service-started switch 33A which is one pole of a double-pole, single-throw, momentary, weatherproof, switch located at the service area. Said pole of said switch would then supply low voltage DC power, provided through contact 24 of relay coil 17, to service started lamp 34, being similar in style and design to lamp 16, only typically amber in color, diode 35 and the coil of relay 36. Lamp 34 would be located on the display console and when lit would indicate that service was started on that particular lane, diode 35 would be similar to diode 18 in that it would provide noise suppression during operation of relay 36. Said relay would be a latching type whereby once activated, it would remain on, due to the electrical connection to contact 37 being made to perform same. DC supply voltage would then be available at contact 37 to provide further operations and lamp 34 would remain lit until the relay is de-energized. Said relay would become de-energized only when the DC voltage applied to its coil is disconnected. Contact 38 is another pole of relay 36 made available, but is not used at this time. As previously stated, switch 33 is a double-pole momentary switch being activated by the island attendant when service is started. Switch 33B, the remaining pole of said switch but not previously described is also activated when 33A is switched. Said pole is connected in parallel across relay contact 39 and relay contact 41, said contacts being associated with relay coils 40 and 42, respectively. As switch 33B is activated an audible call and visual annunciation is placed to one lane of intercom 19 due to the particular internal design and circuitry of said intercom, typically known as a chime and light annunciator type of intercom master station having high-power paging facilities and hands-free reply capabilities. As switch 33B is activated, current supplied by the intercom is passed through relay coil 40 to energize same and close contact 39 of said relay coil. Contact 39 then maintains this chime and light on the intercom until such time as the cashier or operator responds to same to obtain the service information from the attendant or customer. It should be made known that if for instance the cashier or operator is already using the intercom, the means of identification of the calling party would be the lamp only, and the cashier or operator would not be interrupted in conversation by the tone. Upon selecting the appropriate lane number on intercom 19, the cashier or operator could talk to the attendant or customer, only after turning the alarm switch 29 on, thus activating relay coil 26 and its associated contacts, namely, alarm contact 25, contact 43 to be described later, and contact 44 which is connected in parallel across voice blocking diode 45. Said diode is used to disable the voice communications between the cashier or operator and attendant, or customer, unless alarm switch 29 is activated. This fact insures that the alarm circuit will be set to operate for all vehicle servicing. When alarm switch 29 is activated, it opens contact 25 as was previously described, opens contact 43 which will be described later, and closes contact 44 which shorts diode 45 and allows for direct voice communication from the intercom 19 to the speaker 47. Capacitor 46 is a non-polar type electrolytic and is used to block the DC voltage of the chime and lamp annunciation but allows voice coupling to the speaker 47. Items 39, 40, 46 and 47 are all located at the service area as well as items 31, 33, 48 and 55.

After servicing the vehicle and determining the quantity and cost of fuel or service performed, attendant or customer activates switch 48A which is one pole of a double-pole, single-throw, momentary weatherproof switch located at the service area. Said pole of said switch would then supply low voltage DC power, provided through latching relay contact 37, to service finished lamp 49 being similar in style and design to lamp 16 only typically blue in color, diode 50, the coil of relay 51 and the coil of electrical vehicle counter 53. Lamp 49 would be located on the display console and when lit would indicate that service was finished on that particular lane, diode 50 would be similar to diode 18 in that it would provide noise suppression during operation of relay 51. Said relay would be a latching type whereby once activated it would remain on due to the electrical connection to contact 52 being made to perform same and lamp 49 would remain lit until the relay is de-denergized. DC supply voltage is now available to contact 43 which at this point is held in a normally open state. Said contact does not close until the alarm switch 29 is turned off, which as a matter of cashier routine occurs when the driver, customer, or vehicle operator prefers to pay his bill, at which time said cashier removes the previously filled out invoice from the appropriate lane slot on the console and switches the alarm switch 29 OFF. This in turn causes relay coil 26 to de-energize and close contact 43 thus supplying DC voltage to illuminate nvoice paid lamps 54 and 55 located on the console and service area, respectively, both of which would be similar in style to lamp 16 and typically green in color and lamp 55 being waterproof.

As previously stated, switch 48 is a double-pole momentary switch being activated by the attendant or customer when service is finished. Switch 48B, the other pole of said switch but not previously described, is also activated when 48A is switched. Said pole is connected to relay coil 42 and diode 56. Said diode being similar to diode 188 in that it would provide noise suppression during operation of relay coil 42. Said relay when supplied DC power through switch 48B would cause contact 41 to close which would then initiate a call to intercom 19, similar to the operation of switch 33B, which has previously been discussed.

We would assume that at this point service is finished, the driver would then go to the cashier to pay his bill. Upon the request of the driver to pay, the cashier would remove his invoice from the appropriate slot, turn alarm switch 29 to the OFF position which would deactivate the alarm as was previously mentioned, disable the intercom, and illuminate lamps 54 and 55 through the closing of relay contact 43. The purpose of invoice paid lamp 55 located at the service area is that in case it is desirable to move the vehicle, a third party at the service area would be made aware that the bill has been paid and that the vehicle could be moved without setting off the alarm.

Finally, as the vehicle is moved after the alarm is turned off, the detector 10 opens switch 11 which turns off the lamp 16 and de-energizes relay coil 17 thereby causing contact 24 to disconnect all voltages supplied to the other parts of circuitry, including the latching relays 36 and 51 which in turn turn off their respective lamps, and counts the vehicle as being serviced on counter 53. If the vehicle leaves without paying the bill and switch 29 was not turned off, the alarm would sound as was previously discussed.

While the invention has been disclosed herein in connection with certain embodiments and certain structural and procedural details, it is clear that changes, modifications, or equivalents can be used by those skilled in the art; accordingly, such changes within the principles of the invention are intended to be included within the scope of the claims below.

What is claimed is:

1. A system for controlling the servicing of vehicles driven by customers arriving in service areas where a vehicle is brought to a stop to obtain service which system comprises, in combination:

means responsive to said arrival of said vehicle in a service area for announcing its arrival and means for electrically energizing a control means which is responsive to an unauthorized departure of said vehicle;

said control means;

an alarm means for effecting an alarm when activated by said control means when it responds to an unauthorized departure;

means for preventing the energizing of said control means in the absence of a stopped vehicle;

means for announcing an authorized departure of said vehicle; and means for preventing the operation of any of the aforesaid means except in a programmed sequence, the first of which sequence after said announced arrival is the activation of said control means.

2. A system in accordance with claim 1 containing means for effecting the announcement of said arrival of said vehicle, said departures of said vehicle, and other facets of the involved transactions to an area removed from said service area.

3. A system in accordance with claim 1 containing a set of electrical lights, each of a different color, as indicia of stages in the service transactions and located in an area separate from the service area.

4. A system in accordance with claim 3 containing a plurality of two colors of said lights and being located in the service area to indicate an allowance of departure or an unauthorized departure.

5. A system in accordance with claim 3 containing means activated in said remote area to signal said service area that the said vehicle has authority to depart.

6. A system in accordance with claim 1 in which said alarm means contain means for activating an intercommunication device.

7. A method for monitoring the servicing of a vehicle driven by a customer arriving at areas to obtain service, which method comprises:

directing a said vehicle into a service area in which said vehicle is to be brought to a stop;

affording at said stopping place a signal means whereby the arrival of said vehicle is announced at such remote area as is desired;

effecting through a request for service via an intercom call-in switch the activation of a control, whereby an alarm is activated in the event said vehicle leaves the said service area in an unauthorized departure and whereby said control means effects a signal in said service area and such remote area as is desired for approving an authorized departure of said vehicle;

providing a means for preventing the activation of said control and its alarms in the absence of a stopped vehicle; and effecting the activation of the various signals only in a programmed sequence, said sequence after said arrival of said vehicle being activation of said control, start of said service, finish of said service, payment for said service, and authorized departure of said vehicle, said alarm being activated in the event said sequence is not followed.

8. A method in accordance with claim 7 in which the various signals are given through a set of electric lights, each of a different color and each indicating a particular stage in the service transactions.

9. A method in accordance with claim 8 in which two colors of said lights are located in the service area to indicate an allowance of departure or an unauthorized departure.

10. A method in accordance with claim 7 in which a plurality of service areas are simultaneously handled, each of which contains means for activating the said controls and alarms.

11. A method in accordance with claim 10 in which each of the plurality of service areas is equipped so that the attendant in said service area may activate the sending of said signals to an area remote therefrom and a second attendant located in said remote area may return signals to a given service area independently of other service areas.

12. Electrical equipment for a system for controlling the service of vehicles driven by customers arriving in areas to obtain service which equipment comprises:

a source of low voltage, direct current power for all elements in said equipment, a detector capable of activating a signal upon the stopping of said vehicle in said area and activating a second signal upon an unauthorized departure of said stopped vehicle, said signal and an inductive switch therefor, said switch being closed by said arrival of said vehicle, a first relay in parallel with and activated by the closure of said inductive switch, in a parallel shunt with said first relay an alarm control and in parallel with said relay a second relay, ohmically connected to a second relay an alarm activation switch for said alarm control, said switch closing and activating said alarm upon a deactivation of said detector caused by said unauthorized departure and the resultant activation of said second signal, in series with said alarm control a reset switch, a double-pole, single-throw switch the closure of which activates at least one service signal, and said service signal.

13. Electrical equipment in accordance with claim 12 containing a standby power source.

14. Electrical equipment in accordance with claim 12 containing a diode in parallel with said inductive switch affording suppression of electrical interference.

15. Electrical equipment in accordance with claim 12 containing a reset switch for said alarm control.

16. Electrical equipment in accordance with claim 12 containing a diode as a block device for voice communications unless the alarm switch is activated.

17. Electrical equipment in accordance with claim 12 in which said double-pole switch activates a series of signals.

18. Electrical equipment in accordance with claim 17 in which said double-pole switch is ohmically connected to an electrical latch which once activated affords continuous activation of said signals until said relay is de-energized.

19. Electrical equipment in accordance with claim 17 in which said signal in said series is activated separately and only in its proper turn as to the other signals, there being as to each signal a relay and a diode to effect said activation.

20. Electrical equipment in accordance with claim 19 in which the last of said signals is ohmically connected to a service completed switch of the double-pole, single-throw type, the activation of which effects a signal showing the completion of said service and the deactivation of which deactivates all elements in said equipment.

21. Electrical equipment in accordance with claim 12 containing a film or video tape camera to obtain evidence in the event of the alarm activation.

* * * * *